US007647795B2

(12) United States Patent
Kitaya

(10) Patent No.: US 7,647,795 B2
(45) Date of Patent: Jan. 19, 2010

(54) PROTECTIVE CASE FOR WASHING CLOTHES

(76) Inventor: Mami Kitaya, 5-34-7 Mihara, Kushiro-shi, Hokkaido (JP)

( * ) Notice: Subject to any disclaimer, the term of this patent is extended or adjusted under 35 U.S.C. 154(b) by 157 days.

(21) Appl. No.: 11/035,951

(22) Filed: Jan. 18, 2005

(65) Prior Publication Data

US 2006/0130537 A1 Jun. 22, 2006

(30) Foreign Application Priority Data

Dec. 16, 2004 (JP) ..... 2004-363825

(51) Int. Cl.
*D06F 1/12* (2006.01)

(52) U.S. Cl. ..... 68/235 R

(58) Field of Classification Search ..... 68/235 R, 68/212, 213; 383/101, 102, 103; 223/84
See application file for complete search history.

(56) References Cited

U.S. PATENT DOCUMENTS 4,532,722 A * 8/1985 Sax ..... 34/60
5,556,013 A * 9/1996 Mayer ..... 223/84
5,829,083 A * 11/1998 Sutton ..... 8/150
5,971,236 A * 10/1999 DesForges et al. ..... 223/84
6,032,495 A * 3/2000 Leu ..... 68/17 R
6,234,368 B1 * 5/2001 DesForges et al. ..... 223/84
D475,821 S * 6/2003 DesForges ..... D32/25
6,742,683 B1 * 6/2004 Phan ..... 223/84

FOREIGN PATENT DOCUMENTS

JP 3069342 3/2000
JP 3069345 3/2000
JP 3111275 9/2000

* cited by examiner

*Primary Examiner*—Joseph L Perrin
(74) *Attorney, Agent, or Firm*—Shlesinger, Arkwright & Garvey LLP

(57) ABSTRACT

In order to obtain a low cost washing clothes case capable of washing a delicate clothes stored therein without damage and with sufficiently removing dirt from the clothes, the washing clothes case is for storing laundry therein on washing by a clothes washing machine. The washing clothes case comprises a container made of hard plastics and having at least one opening portion capable of opening and closing, a floating member attached on one of an outer surface and an inner surface of the container, and a plurality of water holes formed on a region of the container at which the floating member is not attached.

5 Claims, 6 Drawing Sheets

X-X line sectional view

PROTECTIVE CASE FOR WASHING CLOTHES

RELATED APPLICATIONS

This application claims the priority benefit of Japanese Patent Application No. 2004-363825, filed Dec. 16, 2004, incorporated herein by reference.

BACKGROUND OF THE INVENTION

The present invention relates to a washing clothes case for storing a laundry therein on washing the laundry labeled a hand washing or a weak water flow in treatment, without damaging a shape and a fabric material of the laundry in case of washing the laundry in a strong water flow by a clothes washing machine.

Such a conventional art will be described hereinafter.

In washing, easy-care instructions are labeled on laundry. The laundry, which is possible to do water washing, is grouped into one of "hand-washing", "weak water flow", and "strong water flow". Inasmuch as a clothes washing machine cannot be usually used in the laundry labeled hand-washing instruction, you can not be bothered to do a hand-washing. It is uneasy to do a hand washing without damage a shape and a fabric material of the laundry. In addition, the laundry labeled a weak water flow instruction is washed in a manner of drifting in washing water in a few minutes by a weak water flow function of the clothes washing machine. It is difficult to remove dirt from clothes and the clothes may get out of shape on dehydration in some fabric materials. Although fabric clothes such as wool and silk increase which are possible to be washed with water, a washing fashion is still defined to the hand washing or the weak water flow. As a result, there are troubles in which the number of washing increases on the basis of classification and which dissatisfaction remains in removing dirt from clothes.

Inasmuch as the laundry rubs by a whisking operation in washing of strong water flow and snag and twist occur in the laundry, damage occurs in the clothes and the clothes get out of shape. In order to prevent the clothes from getting out of shape, the washing net is used on washing. Inasmuch as the washing net is shaped into a net shaped bag, the laundry put in the washing net is only collected in the bags and receives a mechanical force and the water flow in operation similar to other laundry which is not put in the washing net. Therefore, it is difficult to avoid the laundry from damage in case of washing the laundry labeled the hand washing or the weak water flow, under the strong water flow by using the washing net, although the washing, which prevents the clothes from getting out of shape, is effective in weak water flow.

The present applicant had invented the invention described in the patent publication 1, in order to dissolve the above-mentioned problems. The clothes washing case described in the patent publication 1 is composed of a lower cover portion, an upper cover portion, and a connecting hardware. The lower cover portion has a gradual U-character shaped shallow bowl shape which is directed upwardly. The upper cover portion has a gradual inversed U-character shaped shallow bowl shape which is directed downwardly. The connecting hardware is for use in connecting the lower cover portion with the upper cover portion with the lower cover portion and the upper cover portion being possible to open and close. Each of the lower cover portion and the upper cover portion has two-layer structure which has an inner layer and an outer layer. The inner layer is a net body which is made of hard light-weight plastic. The outer layer is made of a stock absorbing material having elasticity. The outer layer is dotted with water holes. In case where the laundry is stored in the above-mentioned washing clothes case, it is possible to wash delicate clothes by the clothes washing machine without damage, without separating the delicate clothes from other clothes.

Patent Publication 1: Japanese Patent Publication No. 3,111,275

However, the washing clothes case described in patent publication 1 has some troubles which are described hereinafter. Inasmuch as each of the lower cover portion and the upper cover portion has two-layer structure and one of layers is shaped into a net body made of hard lightweight plastic and a plurality of water holes are formed on another one of layers, the washing clothes case is expensive on manufacture and manufacturing process becomes complex.

SUMMARY OF THE INVENTION

Taking the above-mentioned problems into consideration, it is an object of the present invention to provide a washing clothes case having a structure capable of doing a washing with a strong water flow of a clothes washing machine and capable of being manufactured at a low cost, in order to sufficiently remove dirt from delicate clothes stored in the washing clothes case, without preventing the clothes from damage.

In order to accomplish the above-mentioned object, according to a first aspect of the present invention, there is provided a washing clothes case for storing laundry therein on washing by a clothes washing machine. The washing clothes case comprises a container made of hard plastics and having at least one opening portion capable of opening and closing, a floating member attached on one of an outer surface and an inner surface of the container, and a plurality of water holes formed on a region of the container at which the floating member is not attached.

Inasmuch as the washing clothes case comprises the container made of hard plastics and having at least one opening portion capable of opening and closing, the container is not twisted on washing and the strong water flow and the mechanical force do not directly act to the laundry stored in the washing clothes case. As a result, it is possible to wash the laundry with keeping the laundry to original shape and without getting out of shape.

In addition, inasmuch the floating member is partially attached on one of the outer surface and the inner surface of the container, it is easy to make the washing clothes case float near water surface. Therefore, it is possible to reduce influence and entanglement of other laundry.

Furthermore, inasmuch as the floating member is partially attached on the container and a plurality of water holes formed on the region of the container at which the floating member is not attached, it is possible to simplify a manufacturing process and to reduce a cost in comparison to Patent Publication 1 in which the container has the two-layer structure. In addition, inasmuch as washing water passes through only the water holes, it is possible to gradually wash the stored laundry by water passing operation even if water flow is strong. Inasmuch as the release of the water is restricted on dehydration, the dehydration weakly acts to the laundry and it is possible to prevent the laundry from wrinkle.

According to a second aspect of the present invention, a concave portion is formed on the container. The concave portion is concave with directing from the outer surface to the inner surface of the container. The floating member is engaged in the concave portion.

Inasmuch as the concave portion is formed on the container and the floating member is engaged in the concave portion, it is possible to strongly fix the floating member to the container.

According to a third aspect of the present invention, a continuous surface is formed by a surface of the floating member engaged in the concave portion and the outer surface of the container except the concave portion.

Inasmuch as the continuous surface is formed by a surface of the floating member engaged in the concave portion and the outer surface of the container except the concave portion, it is possible to make the entire outer surface of the container be smooth surface. As a result, it is possible to further reduce influence and entanglement of other laundry.

According to a fourth aspect of the present invention, roundness is formed on a corner portion of a part projecting to inside of the container in correspondence to the concave portion.

Inasmuch as roundness is formed on a corner portion of a part projecting to inside of the container in correspondence to the concave portion, it is possible to prevent the stored laundry from damage based on catching and rubbing.

According to a fifth aspect of the present invention, a shock absorber is attached to a corner portion or projection portion which is positioned on the outer surface of the container.

Inasmuch as the shock absorber is attached to a corner portion or projection portion which is positioned on the outer surface of the container, it is possible to prevent the washing tub from damage and to reduce a sonic boom even if the washing clothes case is contact with the washing tub. As a result, it is possible to secure safety.

According to a sixth aspect of the present invention, the container is formed by a pair of bowl shaped members which are similar in shape to each other. The bowl shaped members are opposite to each other to arrange the circumference edges in order to form the container. The container comprises hinge member for connecting the bowl shaped members capable of opening and closing and a stopping member for fixing the bowl shaped members in a closed state. The floating member is attached to a bottom portion of each of the bowl shaped members. The water holes are formed on a side wall portion of each of the bowl shaped members.

As described above, the bowl shaped members are opposite to each other to arrange the circumference edges in order to form the container and the floating member is attached to a bottom portion of each of the bowl shaped members. Furthermore, the water holes are formed on a side wall portion of each of the bowl shaped members. As a result, the washing clothes case has a shape having roundness without existing a sharp corner portion and a projection on the outer surface of the washing clothes case. Accordingly, it is possible to prevent the washing clothes case from deformation based on pressure. Even if the washing clothes case is put in the washing tub together with general laundry, friction does not occur between the washing clothes case and general laundry. Therefore, it is possible to prevent the general laundry from damage.

Inasmuch as the floating member is attached to a bottom portion of each of the bowl shaped members, it is easy to keep the bottom portion to a parallel state with respect to the water surface when the washing clothes case floats on the water surface. Therefore, the water passing is not interfered through the water holes which are formed on the side wall portion. In addition, it is possible to further reduce influence and entanglement of other laundry. Furthermore, it is possible to reduce the shock to the laundry stored in the washing clothes case.

Inasmuch as the washing clothes case comprises a structure having a storing space in the container, it is possible to effectively remove the dirt from the laundry by the strong water flow of the clothes washing machine without damaging the laundry in comparison to hand washing, because the strong water flow effectively removes the dirt from the laundry in comparison to the weak water flow. Therefore, it is unnecessary to separately wash the laundry on the basis of strength of the water flow and to carry out the hand washing. Inasmuch as it is possible to put the washing clothes case in the washing tub together with the general laundry and to simplify washing, it is possible to reduce the number of washing reduces and it is unnecessary to carry out washing at much expense in time and effort. As a result, it is possible to reduce consumption of water and electric power and to effective use time.

Although it is difficult to remove an aqueous dirt such as sweat from the clothes labeled a dry-mark, in a dry-cleaning, it is possible to remove the aqueous dirt such as sweat from the clothes labeled a dry-mark by the clothes washing machine when using the washing clothes case under the suited detergent. As a result, it is possible to reduce the expense for cleaning. Inasmuch as it is possible to apply the washing clothes case to a sort of clothes without limiting the delicate clothes, it is possible to restrain degradation based on washing and the clothes wears well.

PREFERRED EMBODIMENTS OF THE INVENTION

Figure 1:
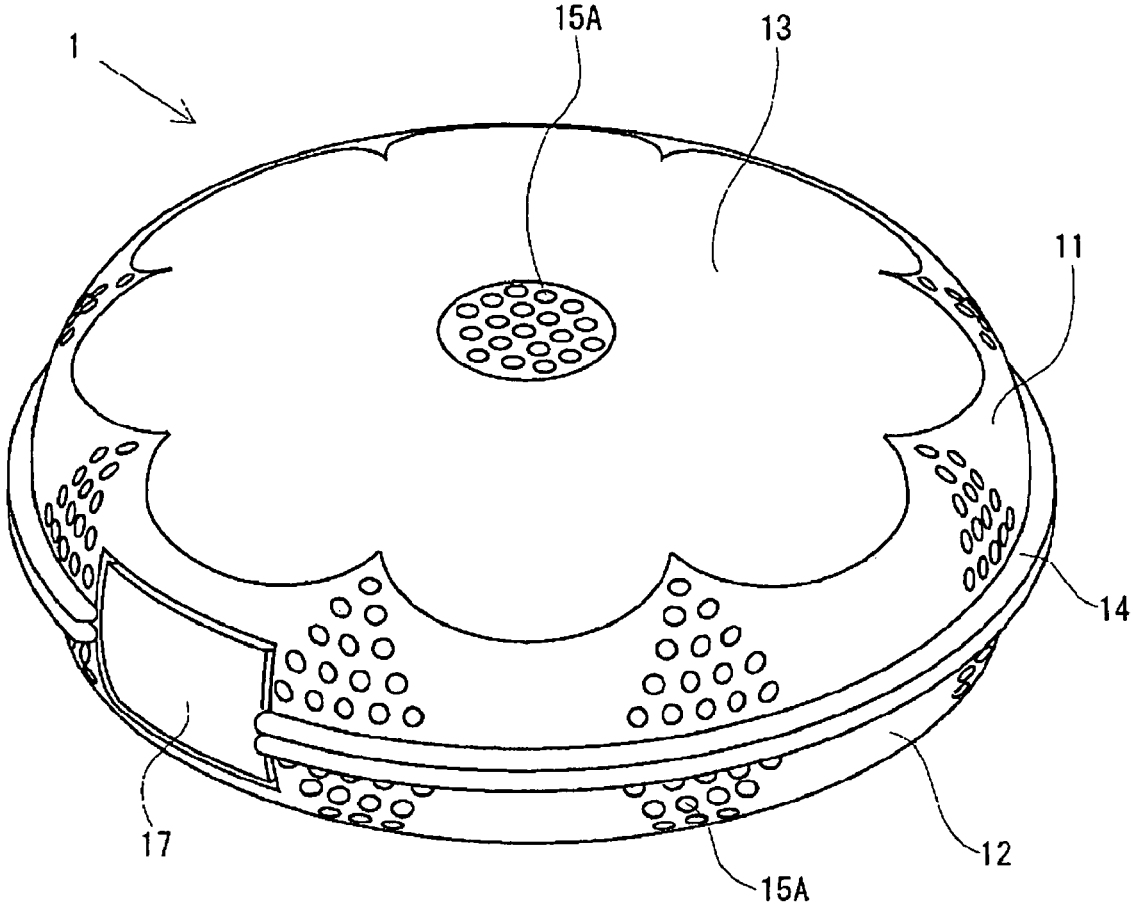
FIG. 1 shows an outside prospective view for illustrating a washing clothes case according to a first embodiment of the present invention.

A washing clothes case of the present invention has a main body or container made of hard plastics. The main body is for storing a laundry and has at least one of opening portion which is capable of opening and closing. The external shape of the container is optional. More particularly, the container is shaped into a rectangular solid, a spherical body, an elliptic body, cylinder solid, shapes partially changing these objects, or shape combining these objects. The opening portion capable of opening and closing may have, for example, an opening and closing cover which is formed a part of wall of one container. Alternatively, one container is divided into two sections which are connected to each other by a hinge, in order to be capable of opening and closing, as another example of the opening portion.

The hard plastics used as a material of the container usually has a bending elastic modulus of 7000 kg/cm$^2$ or more in a steady state. Therefore, it is possible to use a general thermosetting resin (melamine resin, phenol resin, unsaturated polyester resin or the like), styrol resin, acrylate resin, polypropylene, polycarbonate, or the like.

Furthermore, the washing clothes case of the present invention has a floating member which is partially attached to an outer surface or an inner surface of the container. "Partially" means that the floating member is not attached to entire surface of the container. The floating member is shaped into a thin film which has a thickness which is nearly equal to the wall thickness of the container. The contour of the floating member is not defined. The floating member attached to the container may be one or may be divided into a plurality of parts when obtaining sufficient buoyancy. In case where the floating member is divided into a plurality of parts, the parts are optionally located on the container. Preferably, the floating member is evenly located on the entire container. More specifically, it is preferable to symmetrically locate the floating member on the container (referring to an illustrated embodiment hereinafter) in case where the container has a symmetrical shape. On attaching the floating member on the container, the floating member may be integrated on the outer surface or the inner surface of the container. Alternatively, the floating member may be inserted in a concave portion which is formed on the wall of the container. The floating member is attached in the concave portion by bond, fusion bond, mechanical inlet or the like. In case of inserting the floating member into the concave portion of the wall of the container, the inserted floating member may project from the surface of the container or the surface of the floating member may forms a continuous surface together with the surface of the container.

The floating member is made of material exercising buoyancy which makes the washing clothes case float on the water surface or near. The floating member is made of plastics which has specific gravity less than one. For example, the floating member is made of expanded plastics such as polypropylene, polyethylene, hard polyurethane form, or the like.

Inasmuch as the above-mentioned floating member is partially attached one the outer surface or the inner surface of the container, the floating member does not exists one a part of surface of the container. In the washing clothes case of the present invention, a plurality of water holes are formed one the part at which the floating member does not exist. The size of each water hole is defined in an upper limit to a size in which the stored laundry slips out of the water hole. The size of each water hole is defined in a lower limit to a size in which washing water smoothly flows in and flows out. Incidentally, the volume of water, which flows in and flows out of a storing space, becomes great as the total area of the water holes becomes great. As a result, the water flow pressure becomes strong with respect to the stored clothes. Therefore, the total area of the water holes is defined to a area in which damage occurs in the clothes. For example, it is preferable to make the total area of the water holes be defined to a area which is not greater than 50% of total area of outer surface of the container. Each water hole may be shaped into circle, ellipse, square, slit, or the like. Although the water holes are located on the part at which the floating member is not inserted, it is preferable to evenly locate the water holes on the surface of the container.

In case where a square portion or a projection portion exists on the outer surface of the container, it is preferable to attach a shock absorber on the square portion or the projection portion. The square portion or the projection portion on which the shock absorber is attached is not defined to a sharp projection. Even if the square portion or the projection portion has a slight roundness, the slight roundness is included in the square portion or the projection portion when the slight roundness has a convex surface which is directed to outside. The shock absorber is for preventing a washing tub from damage and is for restraining a sonic bang in case where the washing clothes case is contact with the inner wall of the washing tub or collides with the inner wall of the washing tub. The shock absorber is made of a material having elasticity that buffers a shock. For example, the shock absorber is made of polyethylene foam, EVA resin, ABS resin, thermoplastic elastomer, or the like.

Figure 2:
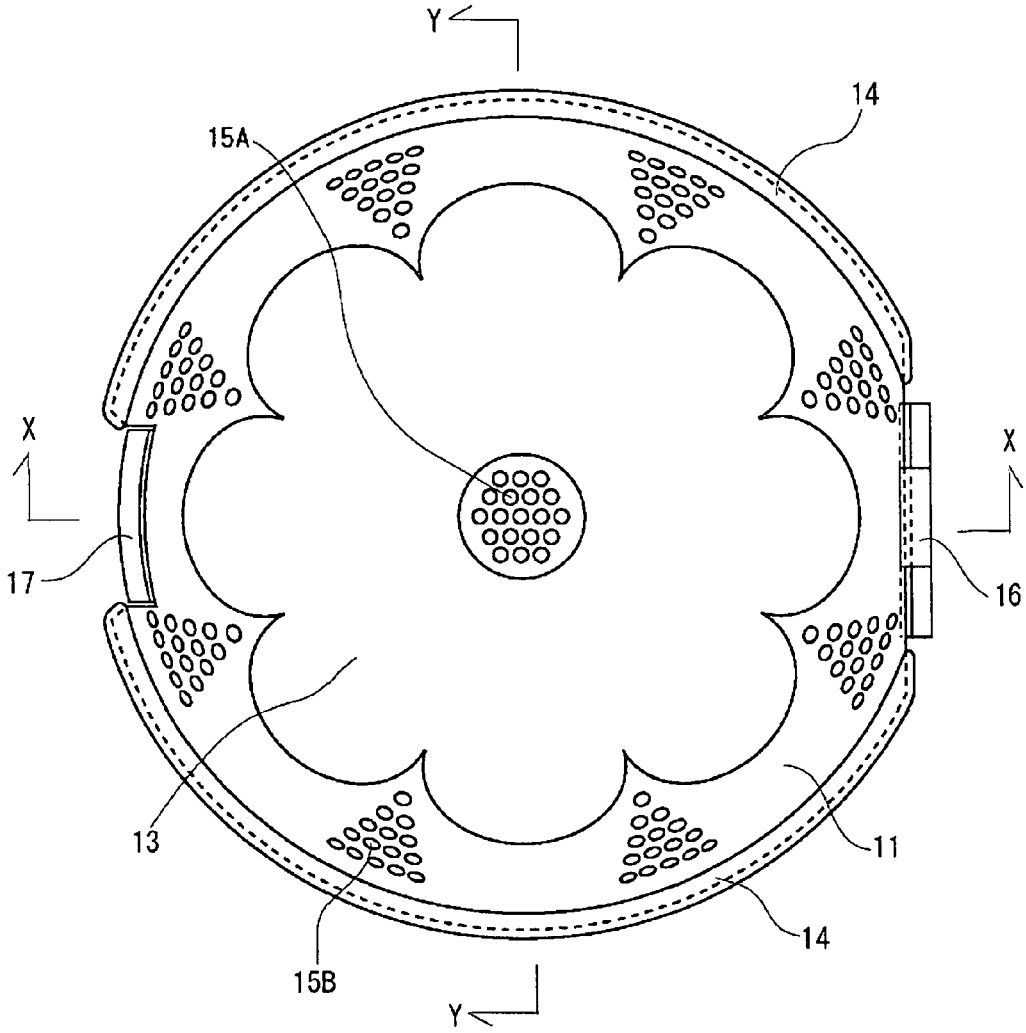
FIG. 2 shows a plane view of the washing clothes case illustrated in FIG. 1.
Figure 3:
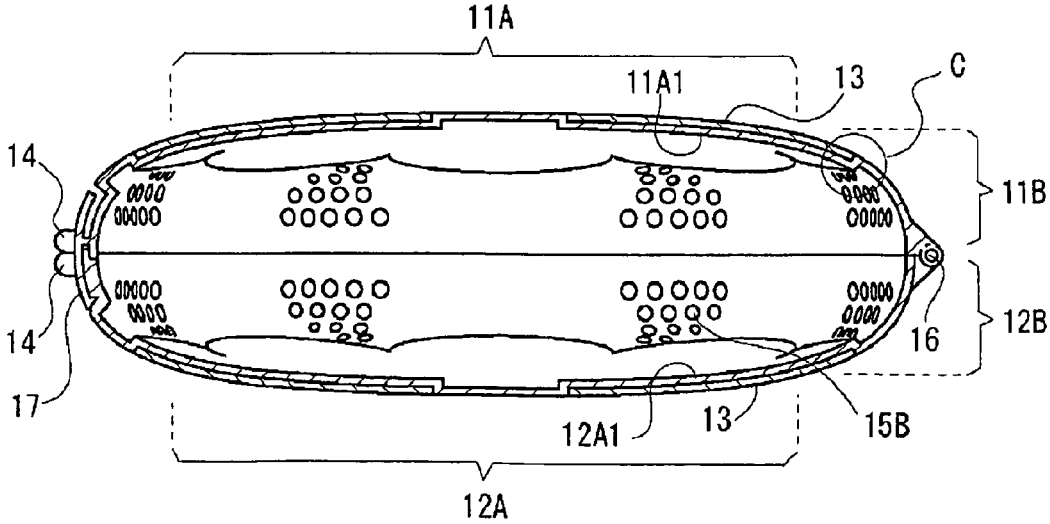
FIG. 3 shows a sectional view along X-X line of FIG. 2.
Figure 4:
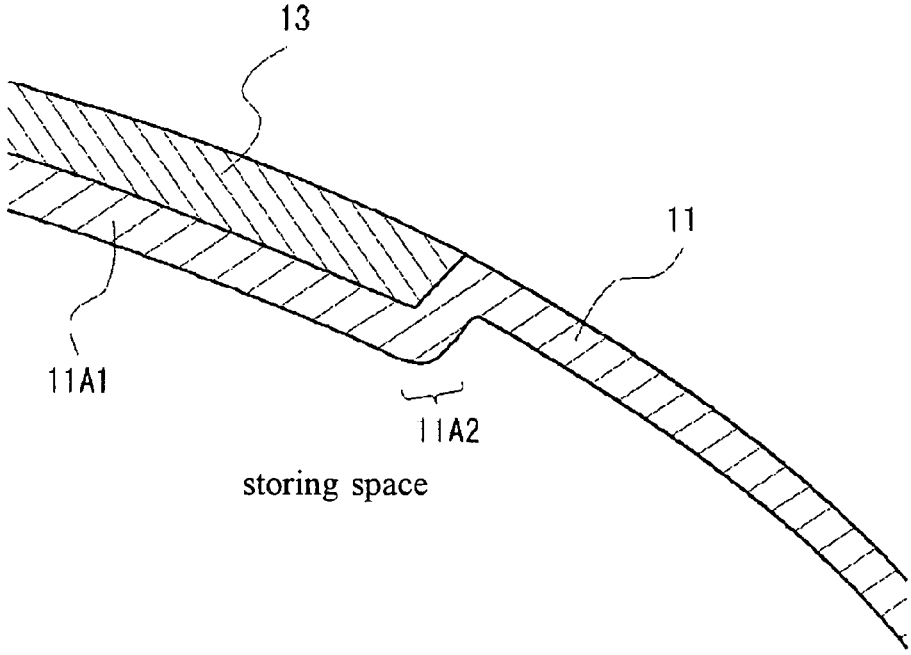
FIG. 4 shows a partially enlarged view of FIG. 3.
Figure 5:
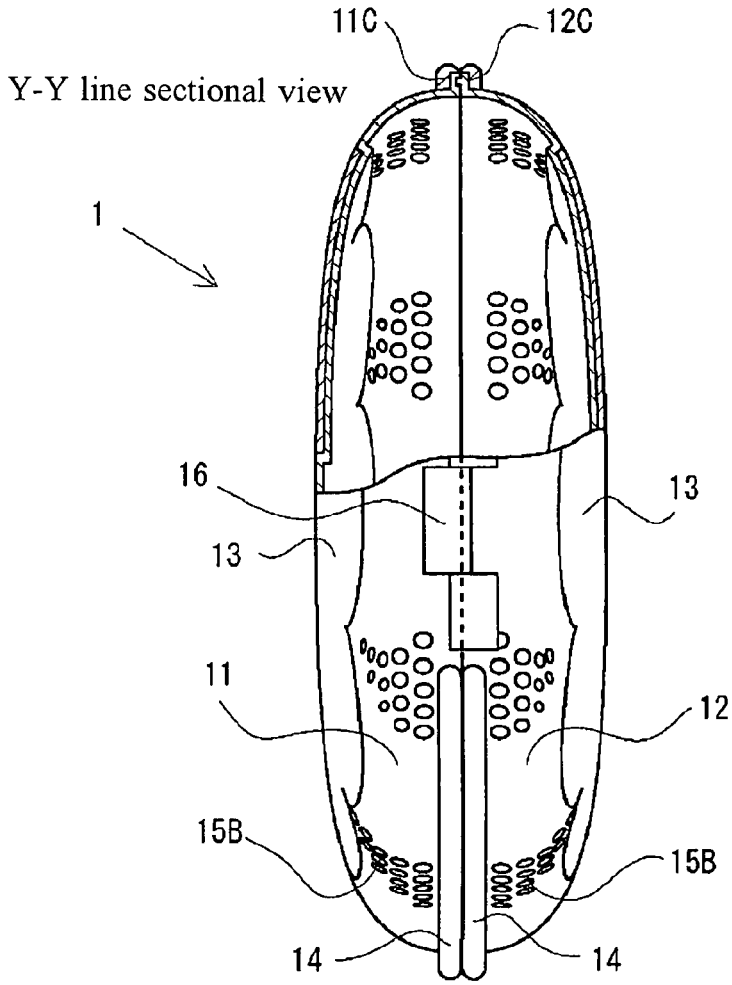
FIG. 5 shows a sectional view along Y-Y line of FIG. 2.
Figure 6:
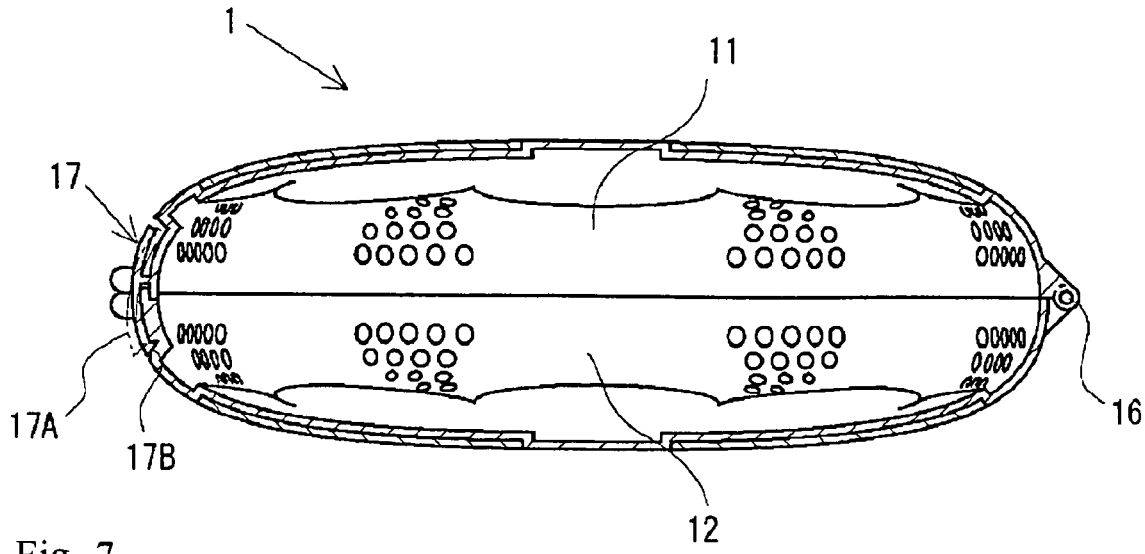
FIG. 6 shows a side sectional view for illustrating a closed condition in the first embodiment.
Figure 7:
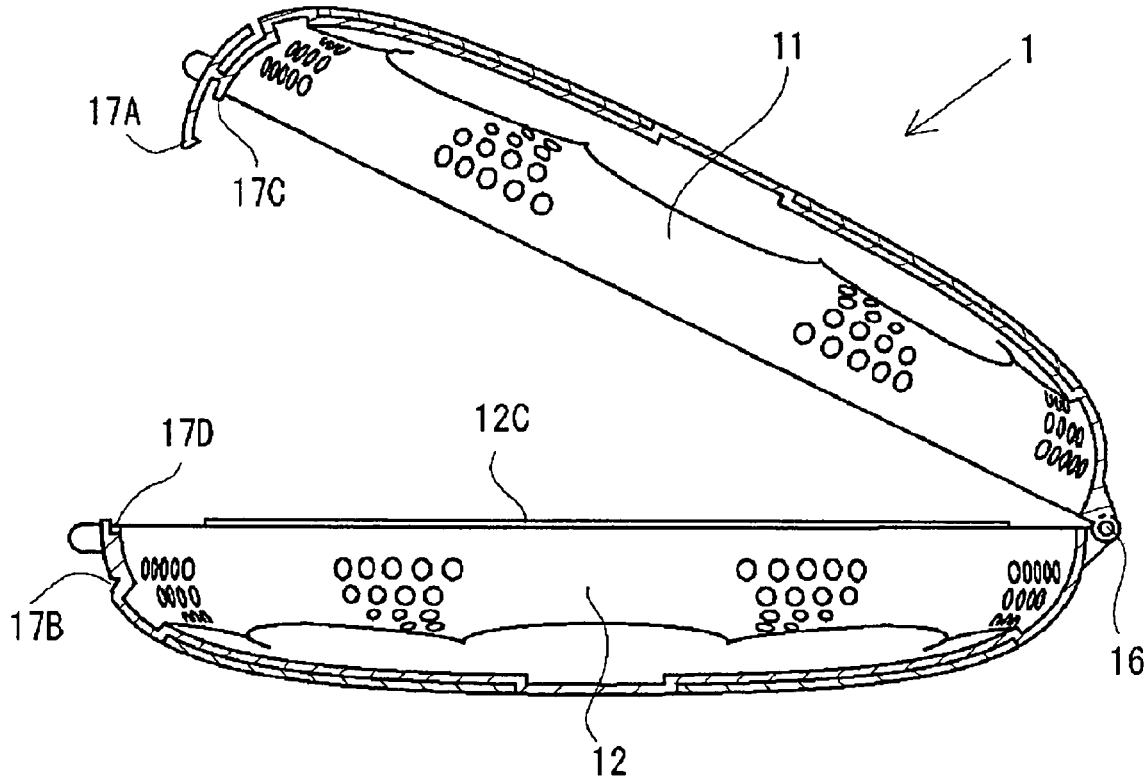
FIG. 7 shows a side sectional view for illustrating an opened condition in the first embodiment.
Figure 8:
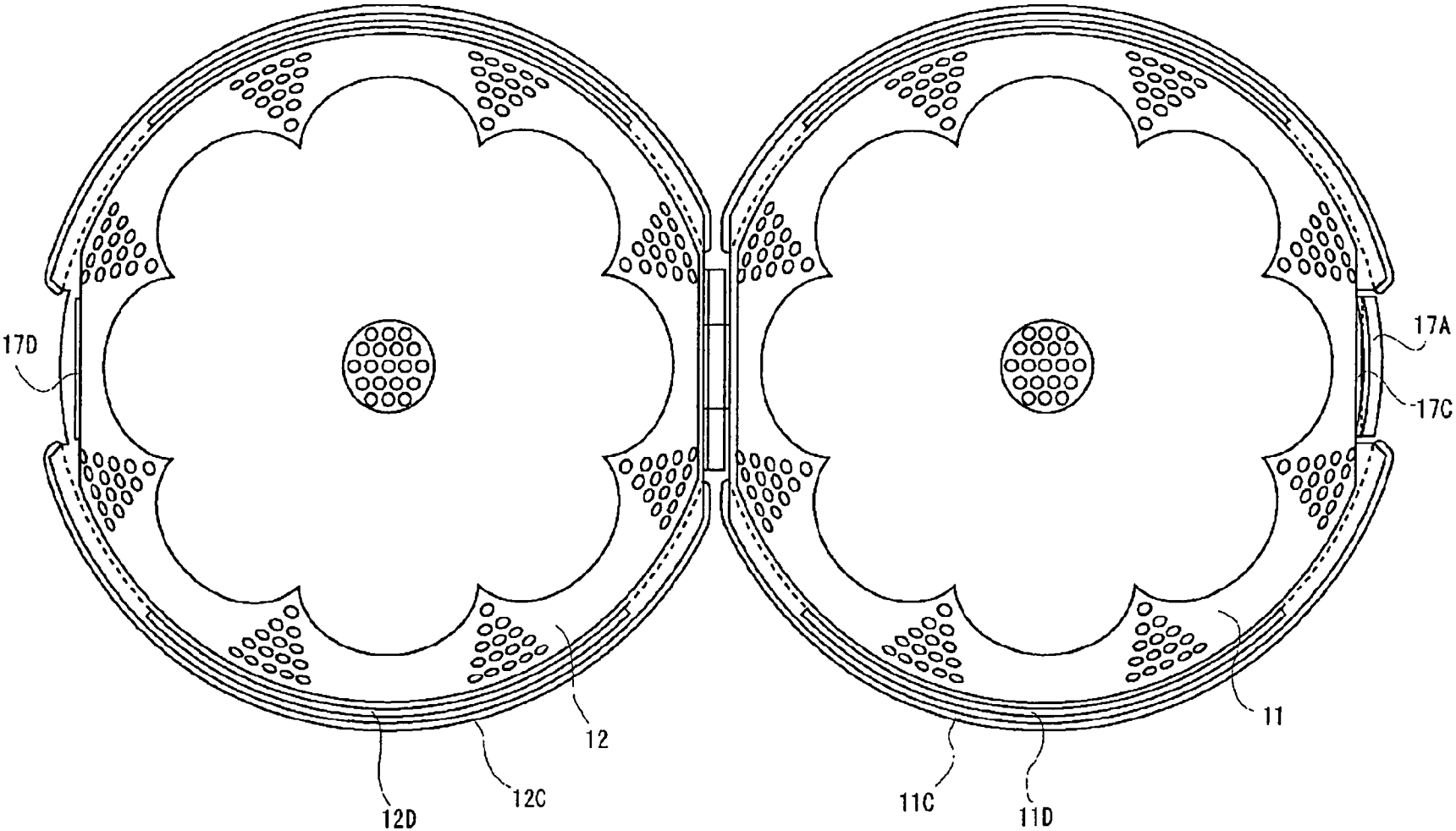
FIG. 8 shows a plane view for illustrating a condition opened at 180 degrees in the first embodiment.

With reference with drawings which illustrate a preferred embodiment, a detailed description will be made. FIG. 1 shows an outside prospective view for illustrating a washing clothes case according to a first embodiment of the present invention. FIG. 2 shows a plane view of the washing clothes case illustrated in FIG. 1. FIG. 3 shows a sectional view along X-X line of FIG. 2. FIG. 4 shows a partially enlarged view of FIG. 3. FIG. 5 shows a sectional view along Y-Y line of FIG. 2. FIG. 6 shows a side sectional view for illustrating a closed condition. FIG. 7 shows a side sectional view for illustrating an opened condition. FIG. 8 shows a plane view for illustrating a condition opened at 180 degrees.

As shown in the prospective view of FIG. 1, the container which is main body of the washing clothes case 1 comprises a pair of bowl shaped members 11 and 12 which are similar to each other. Edges of bowl shaped members 11 and 12 correspond to each other and adhere to each other, in order to form a storing space therein. Each of bowl shaped members 11 and 12 has a circumference edge of circular shape. Incidentally, the size of each of the bowl shaped member 11 and 12 is determined on the basis of the amount of clothes which is stored in the storing space.

As shown in the plane view of FIG. 2, a pair of bowl shaped members 11 and 12 are connected to each other by a hinge portion 16 which is mounted on a part of each circumference edge. The bowl shaped members 11 and 12 are capable of opening and closing by using the hinge portion 16 as an axis, as shown in FIGS. 6 and 7, in order to form the opening portion.

In the plane view of FIG. 2, a stopping portion 17 is mounted on an opposite circumference edge opposite to the circumference edge at which the hinge portion 16 is mounted. The stopping portion 17 is for fixing the pair of bowl shaped members 11 and 12 in the closed condition. Incidentally, it is preferable to evenly fix the bowl shaped members 11 and 12 by a plurality of stopping portions 17, in case where the size of each of the bowl shaped members 11 and 12 is large.

As shown in X-X line sectional view of FIG. 3, the bowl shaped members 11 and 12 which are similar in shape to each other have about flat bottom portions 11A and 12A and side wall portions 11B and 12B, respectively. The side wall portions 11B and 12B are bent from the circumferences of the bottom portions 11A and 12A, respectively, to be directed to a vertical direction. "about flat" means that the bottom portions 11A and 12A may have a gradual curve surfaces, respectively. Accordingly, the bottom portions 11A and 12A are approximately parallel to each other, when the washing clothes case 1 is closed. Strict boundaries do not exist between the bottom portions 11A and 12A and side wall portions 11B and 12B and form gradual curve surface. The side wall portions 11B and 12B extend to vertical directions near the circumference with respect to the bottom portions 11A and 12A, respectively. Therefore, both of the side wall portions 11B and 12B are connected to each other so that the side wall portions 11B and 12B form a continuous surface, when the bowl shaped members 11 and 12 are contact with each other at the circumference edges.

As shown in FIG. 3, concave portions 11A1 and 12A1 are formed on at least parts of the bottom portions 11A and 12A of the pair of bowl shaped members 11 and 12, respectively. The concave portions 11A1 and 12A1 dent from the outer side to the inner side. Floating members 13 are inserted into the concave portions 11A1 and 12A1, respectively. In the present embodiment, the outer surface of the washing clothes case 1 becomes smooth surface when the floating members 13 is engaged into the concave portions 11A1 and 12A1, inasmuch as the floating members 13 are similar in shape to the concave portions 11A1 and 12A1. The size of the floating member 13 is determined to a size in which sufficient buoyancy is obtained. Namely, the area and the depth of each of the concave portions 11A1 and 12A1 is determined to an area and a depth in which sufficient buoyancy is obtained.

In the present embodiment, the floating member 13 has a shape which is preferably symmetric with respect a center of each of the bottom portions 11A and 12A. As a result, balanced buoyancy is obtained which makes the washing clothes case 1 float in a level approximately parallel to the water surface. In addition, the floating members 13 may extend to the side wall portions 11B and 12B without the locating range is not defined to the bottom portions 11A and 12A, although the floating members 13 are located on at least parts of the bottom portions 11A and 12A. The floating member 13 may be divided into a plurality of floating portions and the floating portions may be evenly located on the outer surface of the washing clothes case 1.

Inasmuch as the pair of floating members 13 are engaged into the pair of approximate flat bottom portions 11A and 12A of the washing clothes case 1 as described above, each of the floating members 13 makes the washing clothes case 1 be positioned to approximately parallel to the water surface when the washing clothes case 1 is put in the washing tub. As a result, the washing clothes case 1 receives the water flow and floats on the water surface with maintaining a parallel state near the water surface.

Furthermore, a plurality of water holes are formed on the pair of bowl shaped member 11 and 12 which are form the washing clothes case 1. The water holes penetrate the region at which the floating members 13 are not engaged. For example, a plurality of water holes 15A dot a central regions of the bottom portions 11A and 12A. A plurality of water holes 15B dot the side wall portions 11B and 12B.

A shock absorber 14 is mounted on the outer side of each circumference edge of the pair of bowl shaped members 11 and 12. As shown in Y-Y line sectional view of FIG. 5, the shock absorber 14 of the present embodiment has a shape in which a ring is divided into two ring portions. The shock absorbers 14 are attached to projection portions 11C and 12C which are project to the outer sides along the circumference edges of the bowl shaped member 11 and 12. The thermoplastic elastomer may be used as the shock absorber 14 to be integrated to the bowl shaped members 11 and 12.

FIG. 4 shows an outline view which is enlarged a part illustrated in circle C of FIG. 3. Inasmuch as the concave portion 11A1 is formed on the bottom portion 11 in the outer surface of the washing clothes case1, a projection part is formed in the storing space in correspondence to the concave portion 11A1. It is preferable to form a roundness to a corner portion 11A2 of the projection part. Incidentally, it is preferable to form the roundness to each of entire corner portions of the projection parts which exist in the storing spate, although one projection part is illustrated in FIG. 4. As a result, it is possible to prevent the laundry from damage which occurs when the laundry catches to the corner portion and rubs against the corner portion, when the stored laundry moves in the stored space.

Referring FIGS. 6 to 8, description will proceed to an opening and closing status of the washing clothes case 1 and an embodiment of the stopping member 17. FIG. 6 shows a view for describing an operation method of opening the washing clothes case 1 of the closed condition. In a locked condition which is illustrated in a solid line of FIG. 6, a hook 17A of the stopping member 17 is stopped in a hook groove 17B. In case of taking off a lock, the top end of the hook 17A is taken out of the hook groove 17B as shown in a broken line. Inasmuch as the central part of the hook 17A is supported on the circumference edge of the bowl shaped member 11, it is possible to easily take the top end of the hook 17A out of the hook groove 17B when pushing the upper end of the hook 17A.

As shown in FIG. 7, it is possible to open the washing clothes case 1 when making the bowl shaped member 11 rotate about the hinge portion 16 which is used as the axis. As readily understood from FIG. 7, a convex guide 17C is formed on the bowl shaped member 11 and is for guiding the stopping member. A concave guide 17D is formed on the bowl shaped member 12 and is for guiding the stopping member. In the closed condition illustrated in FIG. 6, the convex guide 17C and the concave guide 17D are engaged to each other. As a result, it is possible to surely locate the stopping member of the bowl shaped member 11 to the stopping member of the bowl shaped member 12.

FIG. 8 shows a plane view for illustrating the bowl shaped member 11 and 12 in a condition opened at 180 degrees. An engaging concave portion 11D is formed on the upper surface of the projection portion 11C which projects to the outer side along the circumference edge of the bowl shaped member 11. On the other hand, an engaging convex portion 12D, which corresponds to the engaging concave portion 11D, is formed on the upper surface of the projection portion 12C which projects to the outer side along the circumference edge of the bowl shaped member 12. In case where the washing clothes case 1 is closed, the engaging concave portion 11D and the engaging convex portion 12D are engaged to each other. As a result, it is possible to surely seal the washing clothes case 1.

Figure 9:
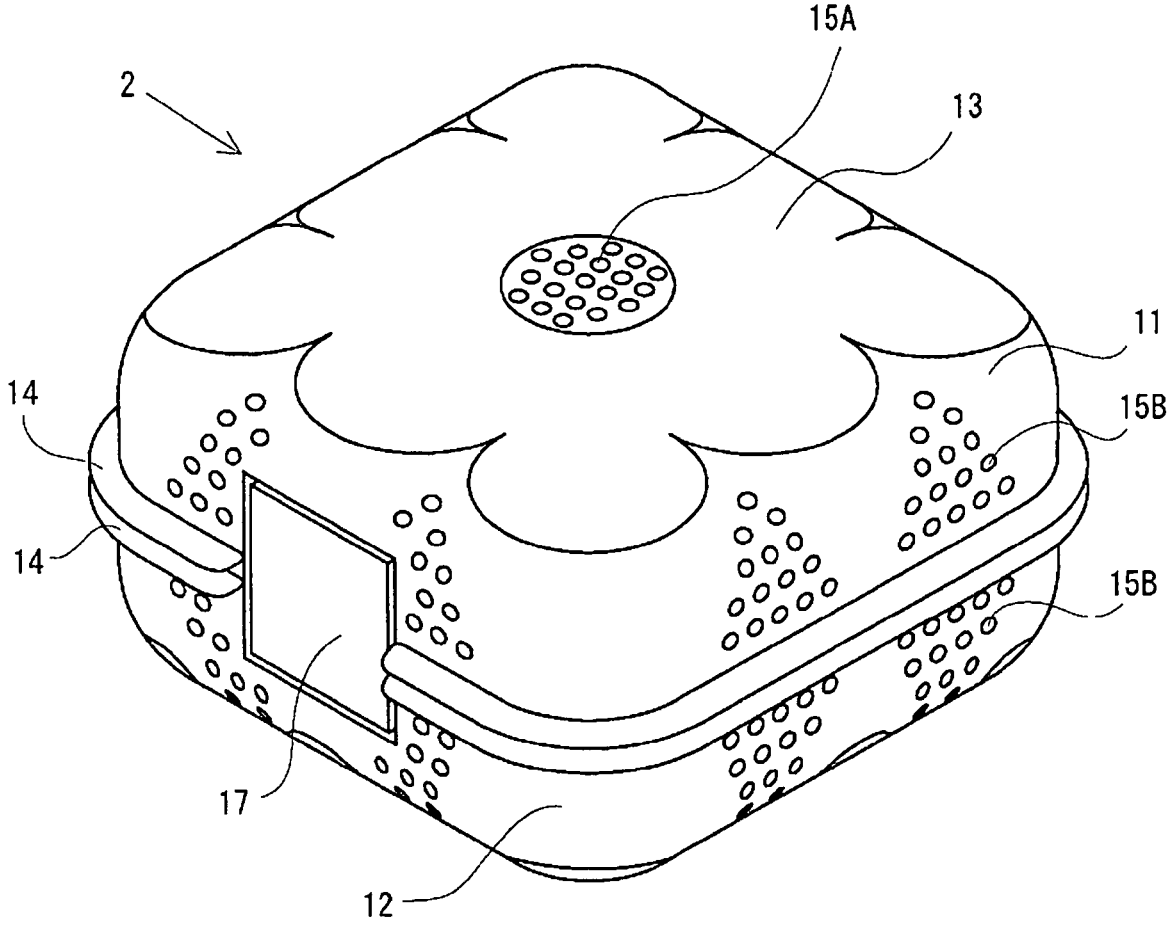
FIG. 9 shows an outside prospective view for illustrating a washing clothes case according to a second embodiment of the present invention.

FIG. 9 shows an outside prospective view for illustrating a washing clothes case according to a second embodiment of the present invention. A washing clothes case 2 illustrated in FIG. 9 is different in structure from the washing clothes case 1 illustrated in FIG. 1. In comparison to the washing clothes case 1, the washing clothes case 2 has bowl shaped member 11 and 12 whose bottom portions are formed in shape to squares, respective. Other parts of the washing clothes case 2 are similar to the washing clothes case 1.

EMBODIMENT 1

A washing test will be carried out in a manner which will be described hereinafter, using the above-mentioned washing clothes case 1 of the present invention.

(Testing Method)

Used clothes washing machine: an automatic clothes washing machine for home (National make) 45K-19 year using Used detergent for washing: "Ariel (registered trademark)+bleach" (P&G company make)

Used detergent for pretreatment: "top pre-care (registered trademark) weak acidity" (Lion make) for strain, food spilled dot (ketchup, soy sauce), "top pre-care (registered trademark) weak alkalinity" (Lion make) for greasy dirt (foundation, lipstick)

Auxiliary tool for washing: washing clothes case (first embodiment of the present invention), washing net (comparison)

Laundry: T-shirt

Washing conditions:

A "Naturally drying the dirt during two hours. After packing the pretreatment detergent to the laundry, putting the laundry in the washing net and washing the laundry under weak water flow. Selecting a minimum level from five washing water level. Setting the washing hour to thirty seven minutes."

B "Naturally drying the dirt during three hours. After packing the pretreatment detergent to the laundry, washing the laundry under strong water flow (general water flow). Washing the general laundry (face towels of four, undershirts for gentleman of four, a drawer for gentleman, and a short panty for gentleman). Selecting a maximum level from five washing water level. Setting the washing hour to thirty seven minutes."

C "After putting the laundry in the washing net, washing the laundry under a manner similar to method B."

D "After putting the laundry in the washing clothes case, washing the laundry under a manner similar to washing condition B."

(Test Result)

Table 1 gives test result.

TABLE 1

| | Degree of removing dirt | Degree of getting out of shape |
|---|---|---|
| A: washing net, weak water flow | X hard to remove | ○ fear of damage |
| B: strong water flow without net | ◎ good to remove | X much damage |
| C: washing net, strong water flow | ○ uneven to remove | Δ damage |
| D: washing clothes case, strong water flow | ○ dirt necessary to pre-treat | ◎ keep the original shape |

Remarks will be described hereinafter with respect to the washing conditions A to D.

A: Inasmuch as the washing net drifts on the washing water with water flow being very weak, it is difficult to remove the dirt from laundry. In addition, it is noted that the laundry is damaged on the mechanical force based on dehydration inasmuch as strong dehydration is carried out during a long time.

B: It is possible to remove the dirt from the laundry very well on the basis of operations of tossing, rubbing, and twisting. However, it is noted that the laundry is greatly damaged in comparison to dirt removal.

C: When the laundry stored in the washing net is becomes a packed condition; it is difficult to evenly remove the dirt from the laundry. In addition, even if the laundry is collected in the bag, it is difficult to avoid the operations of tossing, rubbing, and twisting and it is difficult to buffer the mechanical force. The laundry gets out of shape.

D: Inasmuch as dirt is removed from the laundry by the water flow without the operations of tossing, rubbing, and twisting, it is possible to remove thick dirt of starch shape from the laundry by the pretreatment. Inasmuch as the laundry stored in the washing clothes case directly receives the mechanical force and influence of other clothes till washing to dehydration, it is possible to prevent the laundry from getting out of shape.

As described above, it is possible to obtain a good result with respect to both of the dirt removal and the shape, in case of storing the laundry in the washing clothes case of the present invention and washing the laundry under the strong water flow.

What is claimed is:

1. A protective case for washing clothes, comprising:

a) an enclosed container made of hard plastics, said container having an open or closed position and being formed by a pair of bowl-shaped members similar in shape and opposite to each other, each of said bowl-shaped members having an about flat bottom portion and a side wall portion bent from a periphery of respective said about flat bottom portion;

b) hinge member for connecting said bowl-shaped members for opening and closing;

c) a pair of floating members similar in shape to each other and attached to respective said about flat bottom portion, said floating members being made of plastic having a specific gravity less than one and being symmetric with respect to a center of respective said about flat bottom portion; and d) a plurality of water holes formed on a region of said respective side wall portion of said container.

2. A protective case as in claim 1, wherein:

a) said container includes a concave portion on an exterior surface; and b) said floating member is attached to said concave portion.

3. A protective case as in claim 2, wherein a continuous surface is formed by a surface of said floating member and an outer surface of said container outside said concave portion.

4. A protective case as in claim 2, wherein roundness is formed on a corner portion of a projection corresponding to said concave portion.

5. A protective case as in claim 1, wherein a shock absorber is attached to a projection portion on an exterior surface of said container.

* * * * *